United States Patent [19]

Wilcox

[11] 3,940,508

[45] Feb. 24, 1976

[54] PRECOATING COLOR TELEVISION PICTURE TUBE FACEPLATE PANELS TO PROMOTE PHOSPHOR PATTERN ADHERENCE

[75] Inventor: Harold D. Wilcox, Elmira, N.Y.

[73] Assignee: Westinghouse Electric Corporation, Pittsburgh, Pa.

[22] Filed: Sept. 16, 1974

[21] Appl. No.: 506,649

[52] U.S. Cl. ..... 427/68; 427/72

[51] Int. Cl.[2] ..... B05D 5/06

[58] Field of Search ..... 117/34; 96/36.1; 427/68, 427/72

[56] References Cited

UNITED STATES PATENTS 3,269,838 8/1966 Saulnier ..... 117/34

3,712,815 1/1973 Rohrer et al. ..... 96/36.1

*Primary Examiner*—Ralph Husack

*Attorney, Agent, or Firm*—W. G. Sutcliff

[57] ABSTRACT

An improved precoat layer of highly insoluble, low molecular weight polyvinyl alcohol is uniformly thinly dispersed and dried upon the interior surface of a television picture tube faceplate panel. The precoat is applied by a slurry process with the aqueous slurry containing a predetermined amount of the normally soluble, low molecular weight polyvinyl alcohol and with the material being rendered highly insoluble by adjusting the pH value of the aqueous slurry to a value of less than about 3. The uniformly dispersed and dried precoat provides a highly adherent layer on the glass faceplate panel and the subsequently deposited phosphor pattern is highly adherent to this layer.

5 Claims, No Drawings

PRECOATING COLOR TELEVISION PICTURE TUBE FACEPLATE PANELS TO PROMOTE PHOSPHOR PATTERN ADHERENCE

BACKGROUND OF THE INVENTION

The present invention relates to the fabrication of color television picture tubes. In the manufacturing of such color television picture tubes an array of phosphor patterns are deposited upon the interior surface of the glass faceplate via a photoresist exposure process in which a polymerizable binder material is utilized to adhere the inert phosphor compositions to the glass faceplate. The phosphor patterns are laid down via a slurrying process, with repetitive washings which can remove non-adherent material. In order to promote good adherence of the polymerizable phosphor composition containing slurry, it has been the practice to first apply a thin precoat of highly insoluble, high molecular weight polyvinyl alcohol containing aqueous slurry upon the glass faceplate panel. The high molecular weight material is typically utilized in a concentration of about 0.075 weight percent polyvinyl alcohol, in the precoat slurry. To further improve the adherence of the precoat layer to the glass faceplate it has been the practice to include a predetermined amount of colloidal silica, about 0.075 weight percent, which is uniformly dispersed throughout the slurry to promote further adherence of the precoat to the glass faceplate, and to also promote adherence of the later applied polymerizable phosphor arrays.

The complete fabrication process for preparing such color television picture tubes is set forth in greater detail in U.S. Pat. No. 3,712,815 issued Jan. 23, 1973, and owned by the assignee of the present invention. It should be understood that after deposition of the phosphor array layer and an opaque non-reactive material between the phosphor arrays that the polymerized organic constituents are removed from the picture tube prior to final seal of the picture tube during a high temperature lehr operation. In other words all the organic material which has been utilized in production and fabrication of the faceplate panel must now be removed via a decomposition and outgassing process. It is therefore desirable to minimize the required amount of organic material necessary in the fabrication process. The inclusion of the colloidal silica in the precoat slurry has been required to achieve high adherence of the precoat glass faceplate panel, yet its inclusion necessitates careful control of the dispersion and drying process to prevent formation of what are termed precoat stains. Such precoat stains are produced as a result of selective drying and accumulation of the colloidal silica on specific areas of the faceplate panel and constitute a visual defect which can be carried through to the completed picture tube.

SUMMARY OF THE INVENTION

A method of applying an insoluble highly adherent precoat layer on the glass faceplate panel of a color television picture tube. The phosphor layer and opaque material are to be deposited over and adhered to the precoat layer. An aqueous slurry is prepared containing from about 0.01 to 0.1 weight percent of normally soluble, low molecular weight polyvinyl alcohol. The pH of the aqueous slurry is adjusted by addition of a selected acid to a value of less than about pH 3. The adjusted aqueous slurry is uniformly dispersed over the glass faceplate panel, and is dried thereon to form the insoluble adherent precoat layer.

DESCRIPTION OF THE PREFERRED EMBODIMENT

The generally rectangular spherically curved faceplate panel portion of the color television picture tube is cleaned and the interior surface is thoroughly washed prior to application of the precoat slurry material. An aqueous slurry is prepared by the addition of normally water soluble, low molecular weight polyvinyl alcohol, which by way of example can be the trademarked material Vinol 540, a trademark of AIRCO Chemical Corporation. The aqueous slurry contains from about 0.01 to about 0.1 weight percent of the polyvinyl alcohol. Other low molecular weight polyvinyl alcohol compositions can be utilized with a molecular weight preferably being less than about 50,000. The preferred weight percent concentration of polyvinyl alcohol in the aqueous slurry is about 0.05 weight percent.

The pH of this aqueous slurry will be about neutral, and the pH is then reduced to a value of less than about pH 3 by the addition of the selected acids, such as sulfuric acid or hydrochloric acid. The hydrochloric acid is preferred because it has a lower boiling point. The lower the boiling point of the acid used, the lower the lehring temperature needed to remove the acid residue during the subsequent drying and lehring of the tube. The hydrochloric acid facilitates formation of a present layer over which subsequently dispersed slurries flow more evenly. The pH of the aqueous solution is preferably adjusted to a value of about 2.5 by the addition of hydrochloric acid.

The adjusted pH aqueous slurry is thereafter uniformly dispersed upon the glass faceplate panel which is rotated to form a uniformly thin precoat layer thereon. The precoat layer is dried in place by heating the thinly coated faceplate panel to about 90°F to complete insolubilization of the precoat by driving off the water from the slurry.

The color television picture tube fabrication is thereafter completed utilizing the teachings of the aforementioned U.S. Pat. No. 3,712,815.

I claim:

1. Method of applying an insoluble adherent precoat layer on the faceplate of a color television picture tube over which the phosphor pattern is deposited, which method comprises:

preparing an aqueous slurry containing from about 0.01 to 0.1 weight percent of normally soluble, low molecular weight polyvinyl alcohol having a molecular weight of less than about 50,000;

adjusting the pH of the aqueous slurry to a value of less than about 3;

uniformly dispersing a predetermined amount of the adjusted slurry over the faceplate and drying it thereon to form the insoluble precoat layer.

2. The method specified in claim 1, wherein the aqueous slurry preferably contains about 0.05 weight percent of normally soluble, low molecular weight polyvinyl alcohol.

3. The method specified in claim 1, wherein the pH of the aqueous slurry is preferably adjusted by addition of an acid selected from hydrochloric and sulfuric acid.

4. The method specified in claim 1, wherein the adjusted pH is preferably about 2.5.

5. The method specified in claim 1, wherein the aqueous slurry is dispersed upon the faceplate by rotating the faceplate, and the drying is effected by heating the thinly coated faceplate by rotating the faceplate, and the drying is effected by heating the thinly coated faceplate to complete insolubilization of the precoat.

* * * * *